United States Patent [19]

Rogge

[11] 4,413,560

[45] Nov. 8, 1983

[54] FLEXOGRAPHIC PRINTING PRESS

[75] Inventor: Dieter Rogge, Lengerich, Fed. Rep. of Germany

[73] Assignee: Windmoller & Holscher, Lengerich, Fed. Rep. of Germany

[21] Appl. No.: 195,762

[22] Filed: Oct. 10, 1980

[30] Foreign Application Priority Data

Oct. 12, 1979 [DE] Fed. Rep. of Germany ..... 2941521

[51] Int. Cl.[3] ..... B41F 13/24; B41F 31/00

[52] U.S. Cl. ..... 101/247; 101/352; 101/426

[58] Field of Search ..... 101/182, 352, 216, 219, 101/221, 181, 247, 183, 178, 184, 185

[56] References Cited

U.S. PATENT DOCUMENTS

| | | | |
|---|---|---|---|
| 2,258,653 | 10/1941 | Klingelfuss | 101/247 |
| 3,041,967 | 7/1962 | Nystrand | 101/182 |
| 3,190,218 | 6/1965 | Willard | 101/182 |
| 3,274,930 | 9/1966 | Nagel | 101/221 |
| 3,791,294 | 2/1974 | Skelding et al. | 101/182 |
| 3,792,658 | 2/1974 | Shore | 101/247 |
| 4,109,574 | 8/1978 | Forster et al. | 101/216 |
| 4,185,879 | 1/1980 | Hars et al. | 101/182 |

FOREIGN PATENT DOCUMENTS 2024457 1/1980 United Kingdom .

*Primary Examiner*—Richard J. Apley
*Assistant Examiner*—David J. Isabella
*Attorney, Agent, or Firm*—Fleit, Jacobson, Cohn & Price

[57] ABSTRACT

To facilitate exchanging the plate cylinders in a flexographic printing press, ink roller blocks and bearings for the plate cylinders are movable by controlled drives on guides substantially tangentially to the impression cylinder to limiting positions suitable for the new plate cylinder sizes and at which the plate cylinder gears are axially displaceable to engage the gears of the inking rollers and the impression cylinder gear. The plate cylinders are displaceable in their bearings between a printing position and an inoperative position at which said gears are still in mesh.

2 Claims, 4 Drawing Figures

FLEXOGRAPHIC PRINTING PRESS

Figure 1:
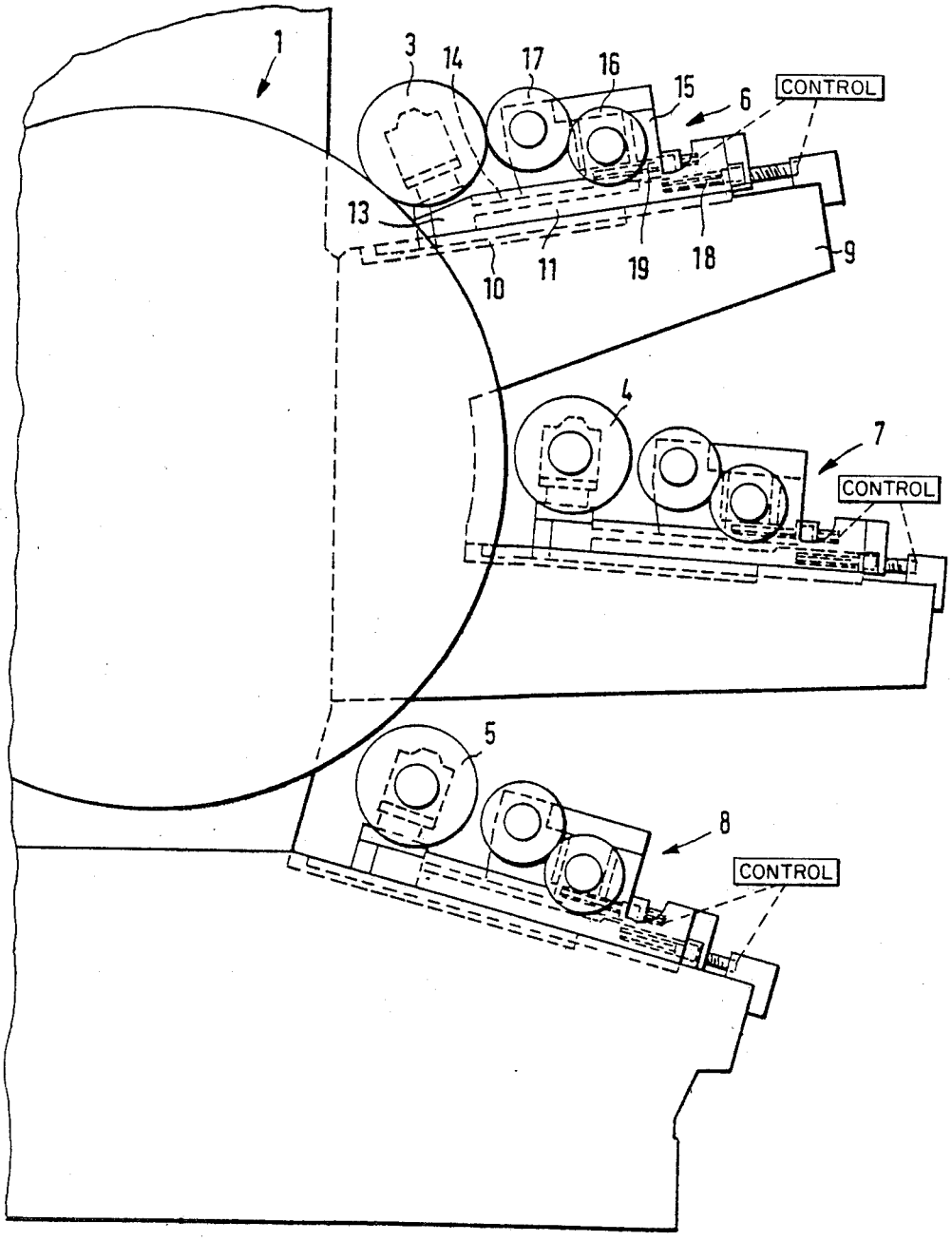

The invention relates to a flexographic printing press comprising an impression cylinder and a plurality of inking mechanisms, wherein the ink roller blocks and the bearings for the plate cylinders are movable on guides substantially radially to the impression cylinder for the purpose of changing the size.

The performance and hence the economy of flexographic printing presses depends, inter alia, on the time and effort required to change the machine to different sizes, i.e. to exchange the plate cylinders.

In flexographic printing presses, it is known for the purpose of changing the size to move the inking mechanisms and the plate cylinders on their guides so far away from the impression cylinder that the plate cylinders can be replaced. After replacement of the plate cylinders, however, the inking mechanisms and the new plate cylinders cannot be readily moved to their limiting position for printing because there is a danger that the apices of the gears that are to be engaged of the inking rollers, the plate cylinders and the impression cylinder will abut one another. Only exceptionally will a position be reached in which the apices of the teeth of the one gear are engaged in the gaps of the other. In the known method, therefore, the gears have to be manipulated prior to movement to their limiting positions in order to align them so that the apices of the teeth of the one gear will engage in the gaps of the other. Since flexographic printing presses may have four to six plate cylinders with associated inking mechanisms applied to the impression cylinder, a change in size calls for a great deal of cumbersome and time-consuming work.

It is the problem of the present invention to provide a flexographic printing press which can be easily and rapidly converted to different sizes.

This problem is solved according to the invention in a flexographic printing press of the aforementioned kind in that, after replacement of the plate cylinder, controls provided for the drives which move the inking mechanisms and bearing blocks of the plate cylinders are actuated so that the drives move the inking mechanism and bearing block of the plate cylinder; to a limiting position corresponding to the new size. The impression cylinder, the plate cylinder. and the components of the inking mechanism of the printing press are mounted on parallel shafts. A gear train has gears mounted on the shafts for synchronous rotation of the shafts during a printing operation. In the previously mentioned limiting position the gears driving the plate cylinders are axially displaceable on their shafts into engagement with the gears driving the inking rollers and with the control impression cylinder gear and are secured to their shafts in these engaged positions. The plate cylinders are displacable in their bearing blocks substantially tangentially to the impression cylinder gear and the associated inking roller gears between their printing positions and an inoperative position where the gears of the plate cylinders are still engaged with the impression cylinder gear and the associated inking roller gears. The flexographic printing press of the invention permits rapid conversion to different sizes in that all the inking mechanisms and all the bearing blocks, after replacement of the plate cylinders, are moved to their limiting positions by the associated controls which are adapted to the different sizes. Consequently, one avoids cumbersome adjustments of the gears that are to be brought into engagement and of the shaft spacings. Before or after moving the inking mechanisms and bearing blocks of the plate cylinders to their limiting positions, the bearings of the plate cylinder shafts are moved tangentially to their inoperative positions. The plate cylinder gears can now be simply axially inserted along their shafts so that they come into engagement with the central impression cylinder gear as well as the associated inking roller gears and they are then secured to their shafts in the inserted position in a suitable conventional manner. To commence printing, it is now only necessary to bring the bearings of the plate cylinders in their bearing blocks from the inoperative to the operative printing positions by means of the associated controls for instance, the piston-cylinder unit moves the bearings of the plate cylinder shaft tangentially to position the plate cylinder in a printing position.

Since the movements of the plate cylinders to and from the operative printing position are achieved by tangential displacement in the flexographic printing press according to the invention, there is the additional advantage that the ink roller blocks and the bearing blocks of the plate cylinders moved to their printing positions can remain clamped to their guides in their printing positions.

To control the drives which move the ink roller blocks and the bearing blocks of the plate cylinders substantially radially, it is desirable to provide microprocessors which are pre-programmed to the limiting positions of all the possible plate cylinder sizes. The micro-processor control permits a particularly simple size variation to be achieved.

To move all the ink roller blocks and the plate cylinder bearing blocks as well as for bringing about the movements to the inoperative printing positions, provision may be made for spindle drives or hydraulic piston-cylinder units.

To set a uniform printed impression, additional provision may be made for mutually independent fine adjustment of the bearings.

Figure 2:
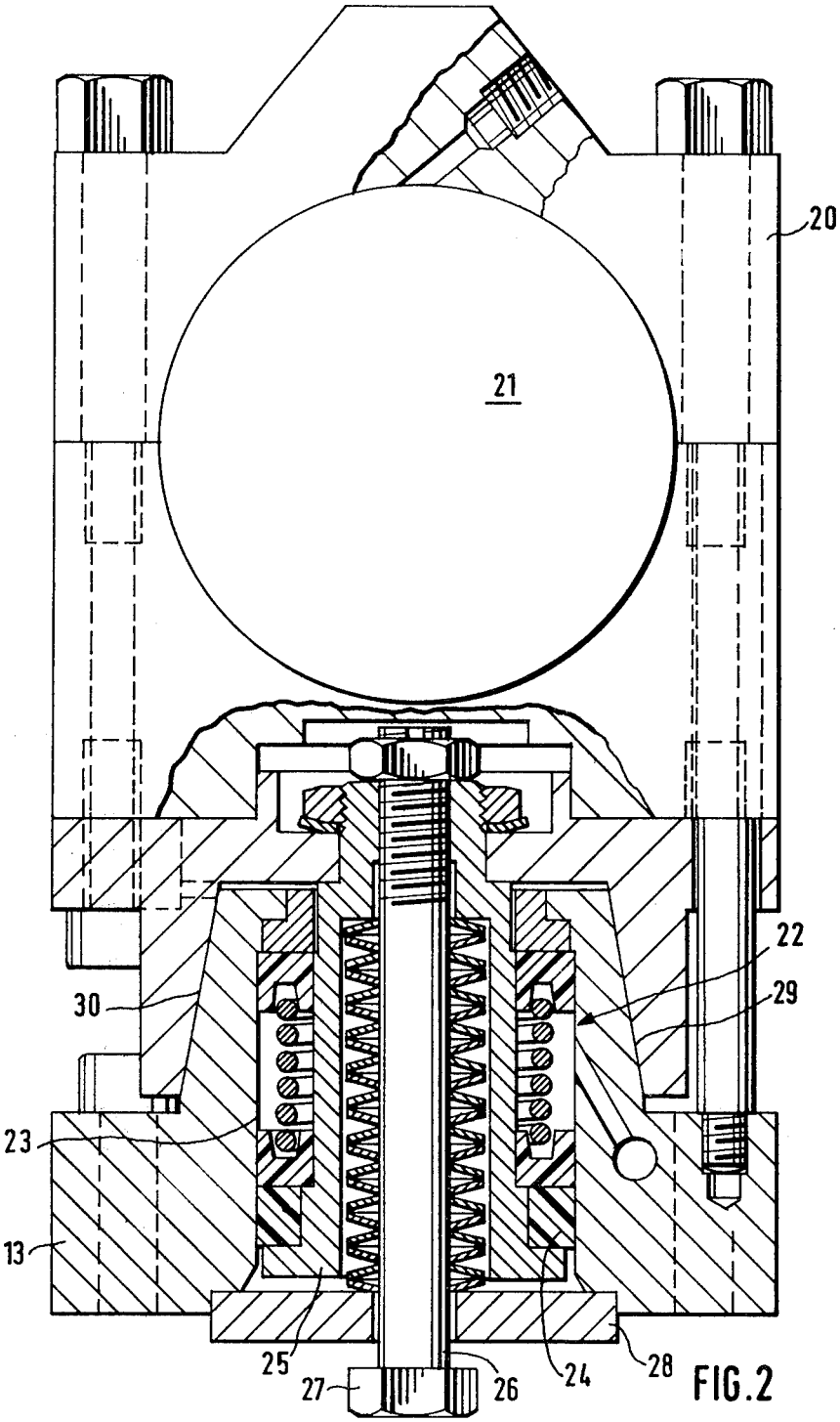
Figure 4:
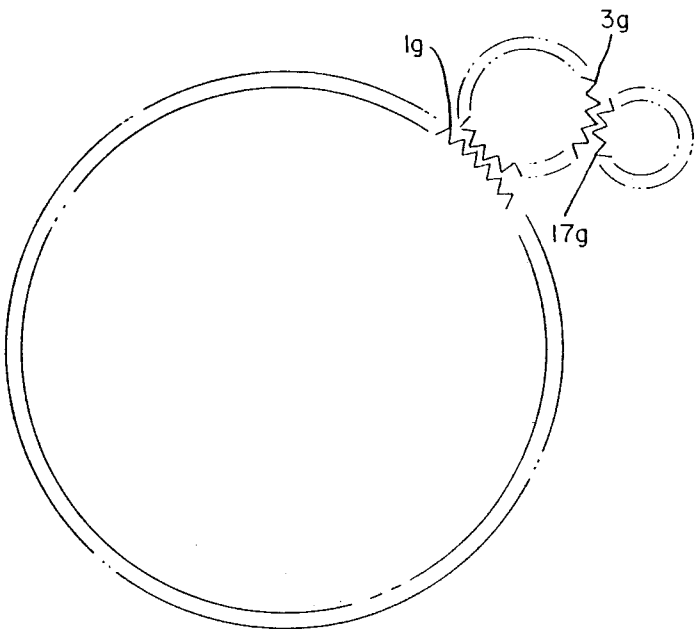
Figure 3:
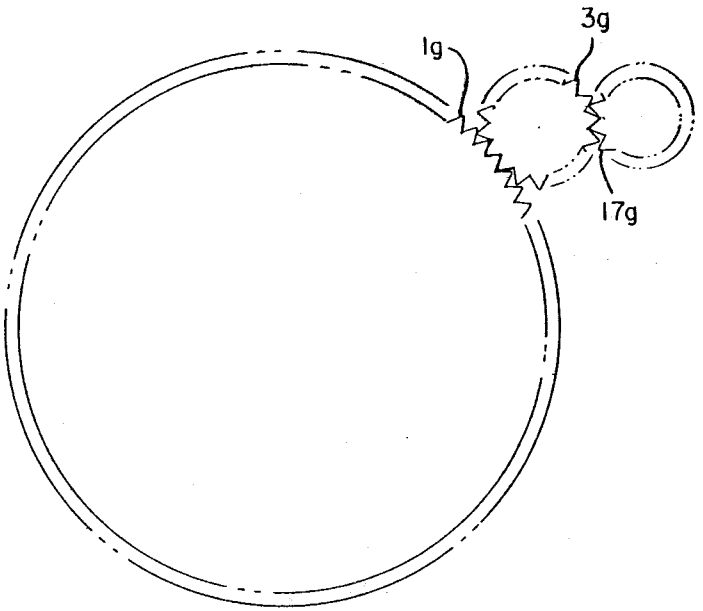

An example of the invention will now be described in more detail with reference to the drawing, wherein:

FIG. 1 is a diagrammatic section through the right-hand half of the flexographic printing press having three plate cylinders and inking mechanisms, FIG. 2 is an enlarged section through the bearing of the uppermost plate cylinder of FIG. 1, FIG. 3 is a schematic illustration of the relationship between gears carried by the impression cylinder, the plate cylinder and the inking roller during a printing operation, and FIG. 4 is a view similar to FIG. 3 with the plate cylinder gear in an inoperative position.

Plate cylinders 3, 4, 5 with the associated inking mechanisms 6, 7, 8 can be applied to the impression cylinder 1. FIG. 1 illustrates the plate cylinder 3 and its associated inking mechanism 6 in a printing position. The plate cylinders 4 and 5 are illustrated in non-printing positions 1. Since the individual plate cylinders and inking mechanisms are the same, they will be described in detail only with reference to the uppermost plate cylinder 3 and its associated inking mechanism 6.

Fixed supporting arms 9 are provided with guides 10 for a carriage 11 which carries the bearing block 13 for the plate cylinder 3 at its front end. The carriage 11 is in turn provided with a guide 14 for the ink roller block. The ink roller block 15 contains an inking mechanism trough in which the immersion roller 16 and the inking roller 17 are mounted. The carriage 11 is longitudinally displaceable on its guide 10 by the spindle 18 and the ink roller block 15 is longitudinally displaceable in its guide 14 by the spindle 19. The spindles 18, 19 are driven by stepping motors (not shown) which are controlled by micro-processors (likewise not described). As illustrated in FIG. 3, the plate cylinder gear 3*g* is in full meshing engagement with the impression cylinder gear 1*g* and the inking roller gear 17*g*. When the plate cylinder 3 is in its inoperative position, the gear 3*g* is in partial meshing engagement with the impression cylinder gear 1*g* and the inking roller gear 17*g*.

It will be evident from FIG. 2 that the bearings 20 of the plate cylinder shaft 21 are displaceable relatively to the bearing block 13 so that, for the purpose of movement to the inoperative position, the plate cylinder 3 is withdrawn substantially tangentially from the impression cylinder 1 as well as from the inking roller 17, it being brought back again if it is to be moved to the printing position. A hydraulic piston-cylinder unit 22 produces the required stroke which is so large that the plate cylinder is lifted off the impression cylinder but the plate cylinder gear 3*g* is not brought out of engagement with the gears 1*g* and 17*g* of the impression cylinder and of the inking roller. The piston-cylinder unit comprises a cylinder 23 formed in the bearing block 13, and the piston 25 which is provided with the lip seal 24. To limit the stroke, the head 27 of a bolt 26 connected to the bearing 20 abuts the plate 28 secured to the bearing block 13 at the end of the movement to the inoperative position.

The bearing block 13 and the bearing 20 are provided with internesting conical faces 29, 30 which lie on each other in the printing position for the purpose of centring the bearing 20.

On changing the size, the plate cylinder 3 is moved away from the impression cylinder 1 and the inking roller 17 moved away from the plate cylinder 3 to such an extent that the plate cylinder 3 can be exchanged for a plate cylinder of a different size. Further, by means of the hydraulic piston-cylinder units 22, the bearings 20 are moved out substantially tangentially so that they are disposed in their inoperative positions. After exchanging the plate cylinder and before the gears 3*g* has been secured to the plate cylinder shaft, the bearing block 13 and, together with the ink trough, the inking roller 17 are moved to positions corresponding to the new size. The plate cylinder 3*g* is subsequently pushed axially onto the shaft 21, brought into loose engagement with the gears 1*g* and 17*g* of the impression cylinder 1 and the inking roller 17, and secured to the shaft 21. As soon as the plate cylinder 3 has been moved to its printing position by the hydraulic piston-cylinder units 22, printing can be recommenced following the change in size. The arrangement of gears is such that at least one gear carried by the plate cylinder shaft is in mesh with the gears on the other shafts throughout the plate cylinder exchange operation.

I claim:

1. In a flexographic printing press including an impression cylinder carrying a gear, a plate cylinder having a shaft carrying a gear, bearing means for supporting said plate cylinder shaft, a bearing block for supporting said bearing means for radial movement towards and away from said impression cylinder, an ink roller for applying ink to said plate cylinder and carrying a gear, an ink roller block for supporting said ink roller for radial movement towards and away from said impression cylinder, and means for moving said bearing block and said ink roller block into limit positions in dependence on the diameter of the plate cylinder so as to position the plate cylinder and the ink roller in limit positions for performing a printing operation, the gears of said impression cylinder, said plate cylinder, and said ink roller being in full meshing engagement with each other during the printing operation, the improvement comprising:

means for moving said plate cylinder tangentially to said impression cylinder between the printing position and an inoperative position, said moving means acting on said bearing means so as to move said bearing means with respect to said bearing block; and means for limiting the amount of movement of said bearing means by said moving means so that the gear carried by said plate cylinder shaft is in partial meshing engagement with the gear carried by said impression cylinder and the gear carried by said ink roller when said plate cylinder is in the inoperative position;

said gear of said plate cylinder being releasably securable on its shaft in a normal functioning position and being axially movable on said plate cylinder shaft so that when said plate cylinder is in its inoperative position said plate cylinder gear is movable from a position spaced from its normal functioning position into its normal functioning position in which the plate cylinder gear is in partial meshing engagement with the impression cylinder gear and the ink roller gear, said plate cylinder gear being movable into full meshing engagement by movement of said bearing means by side moving means to move the plate cylinder into the printing position.

2. Method of exchanging the plate cylinder of a flexographic printing press, including:

an impresion cylinder, a plate cylinder, an ink roller for applying ink to the plate cylinder, the shaft of each cylinder and roller carrying a gear in full meshing engagement during the printing operation, bearing means for supporting the plate cylinder shaft, a plate cylinder bearing block for supporting the bearing means for radial movement towards and away from the impression cylinder, an ink roller block for supporting the ink roller shaft for radial movement towards and away from the impression cylinder, the plate cylinder bearing block and the ink roller block being movable into limit positions in dependence upon the diameter of the plate cylinder used in the printing operation, said method comprising:

moving said plate cylinder bearing block and said ink roller block radially away from their limit positions and away from each other to enable replacement of the plate cylinder, removing the plate cylinder and installing a new plate cylinder in said bearing means, with the gear of the new plate cylinder being axially spaced on the plate cylinder shaft from the normal functioning position occupied by the gear during the printing operation, moving said plate cylinder bearing block and said ink roller block to move the plate cylinder and ink roller into limit positions in correspondence with the diameter of the new plate cylinder;

moving the bearing means relative to the plate cylinder bearing block tangentially with respect to the impression cylinder and ink roller a predetermined distance less than the depth of engagement between the meshing gears, axially sliding the plate cylinder gear along its shaft into its normal functioning position where it is in partial meshing engagement with the impression cylinder gear and the ink roller gear, securing the plate cylinder gear on its shaft; and moving the plate cylinder bearing means relative to the bearing block and tangentially with respect to the impression cylinder and ink roller to locate the new plate cylinder in its printing position and to move the plate cylinder gear from partial meshing into full meshing engagement with the impression cylinder and ink roller gears.

* * * * *